US006328234B1

(12) United States Patent
Saucier et al.

(10) Patent No.: US 6,328,234 B1
(45) Date of Patent: Dec. 11, 2001

(54) APPARATUS AND METHOD FOR RECYCLING SOLID WASTE

(76) Inventors: Kenneth C. Saucier, 10834 Gurney Rd., Baker, LA (US) 70714; Harry J. Geiss, 144 S. Donmoor Ave., Baton Rouge, LA (US) 70806

( * ) Notice: Subject to any disclaimer, the term of this patent is extended or adjusted under 35 U.S.C. 154(b) by 0 days.

(21) Appl. No.: 09/506,985

(22) Filed: Feb. 18, 2000

(51) Int. Cl.[7] ..... B02C 19/18

(52) U.S. Cl. ..... 241/1; 241/23; 241/24.12; 241/299; 241/301

(58) Field of Search ..... 241/1, 301, DIG. 38, 241/299, 24.12, 23

(56) References Cited

U.S. PATENT DOCUMENTS 4,844,351 7/1989 Holloway ..... 241/23
5,035,362 * 7/1991 Mazukiewicz ..... 241/1
5,190,226 3/1993 Holloway ..... 241/23
5,323,969 * 6/1994 Mendenhall et al. ..... 241/1
5,361,994 11/1994 Holloway ..... 241/23

* cited by examiner

*Primary Examiner*—Mark Rosenbaum
(74) *Attorney, Agent, or Firm*—Domingue & Waddell; Henry E. Naylor

(57) ABSTRACT

The invention relates to apparatus and method for the treatment of recyclable materials from solid waste. The material is introduced into a pressure vessel where it is heated and shredded. Fluid jets within the vessel produce a cutting/agitating action on the waste material as it flows through the vessel.

31 Claims, 4 Drawing Sheets

APPARATUS AND METHOD FOR RECYCLING SOLID WASTE

BACKGROUND OF THE INVENTION

1. Field of the Invention

The present invention relates to an apparatus and method for the fragmentation, sterilization, separation, and recovery of recyclable materials from solid waste, such as solid municipal waste, as well as other bio mass materials. The solid waste material is introduced into a rotatable, "kiln-like" pressure vessel with the infusion of a controlled amount of fluid, preferably steam, where it is subjected to elevated temperatures and pressures and mechanical forces exerted within the vessel. Jets of high pressure fluid are used to induce a cutting/agitation action on the waste material as it moves through the pressure vessel.

2. Description of Related Art

Great quantities of solid waste materials, particularly municipal solid waste (MSW), are generated and collected regularly in both rural and urban areas of the United States and other developed countries. Suitable disposal methods are required for such waste. The customary solutions for the disposal of such solid waste materials has been to either deposit them into landfills or to separate the inorganic and organic components and incinerate the organic components, either directly, or in the form of fuel derived from the organic components. However, such disposal methods are becoming increasingly expensive and/or environmentally undesirable.

Processing of municipal solid waste (MSW) to produce solid fuel products suitable for combustion in steam boilers of electric power plants is known and in commercial use.

However, such solid fuel products have serious disadvantages, including an undesirably high moisture content, a high ash content and relatively low heat value. Improvements and innovations in solid waste treatment processes are needed because of the growing economic and environmental needs to recycle and reuse as much of the increasing amounts of municipal solid waste (MSW) material that are produced.

Consequently, the patent literature has been replete with various disclosures concerning MSW management, offering all sorts of methods and techniques to deal with this exploding waste management problem.

One type of technology that is of particular interest for the separation and recovery of municipal waste components is an in-vessel technology that utilizes a pressure vessel for holding the waste where it is rotated, pressurized, and heated with steam while simultaneously being mechanically agitated and moved through the vessel by an extruding action. The extruding action is achieved by a rotatable extruder mechanism in the pressure vessel that forces the solid waste material through one or more constricted areas at the discharge end of the pressure vessel. Such a method, and some of its variations, are disclosed in U.S. Pat. Nos. 4,342,830; 4,450,495; 4,844,351; 5,190,944; and 5,361,994 all to Holloway and all of which are incorporated herein by reference.

While some of the above methods have met with varying degrees of technical and commercial success, they still suffer from inherent problems. For example, in-vessel treatment has become well known in the art and affords some advantage over landfilling and incinerating, but it is very time and labor intensive. It generally does not lead to the cost-effective or efficient recovery of the utilizable inorganic components of a typical municipal solid waste material.

Therefore, "pre-process" classification, segregation and removal of the inorganic portions (metals, plastics, glass, etc.) of the municipal solid waste to be treated is usually necessary. These classification and separation techniques are well known in the art, such as trommel separation or size classification of solid components, air classification systems for plastics, spectrographic segregation for glass, and magnetic and eddy current separation for ferrous and non-ferrous metals. The utilization of conventinoal in-vessel composting methodology, without some form of "pre-process" classification and removal of these inorganic components, contaminates the inorganic components during treatment making the recovery of such components more difficult and substantially depreciating their value. Other difficulties incumbent upon in-vessel treatment of solid waste include the protracted length of time the waste material must remain in the vessel (residence time) for treatment to be completed; and the relatively high moisture content of the end-product. This high moisture content inhibits the separation of the organic components from the inorganic components and necessitates additional drying of the end-product material for further processing. Additional drying is particularly difficult in the in-vessel processes that introduce a relatively high volume of moisture into the vessel in order to fluidize the material.

These noted deficiencies are overcome by the practice of the present invention that eliminates the need for any "pre-process" classification of the mixed municipal solid waste and does not instill any extraneous or unnecessary water into the system. The moisture content of the end-product exiting the vessel of the present invention will not exceed 30%, preferably it will not exceed 20%, by weight. The present process has the additional advantage of producing an end-product from biomass that is relatively dry and readily utilizable for numerous products, including a fuel product. The present invention also has the advantage of sterilizing the inorganic components of municipal solid waste and rendering such components readily recoverable from the waste stream because of the removal of labels and coatings from them.

SUMMARY OF THE INVENTION

The objectives of the present invention are to provide an apparatus and method for the facile and cost-effective recovery of the majority of recyclable components in solid waste, preferably municipal solid waste. The objectives of this invention will also provide a method for the processing of other segregated bio-mass feed stocks, such as bagasse, greenwaste, and the like. This is accomplished through rapid fractionalization of the organic components, along with the sterilization and preparation of the inorganic components for recovery. The sterilization and preparation of the inorganic components is accomplished without any pre-process handling or segregation of inorganic components from organic components of the solid waste.

In accordance with the present invention there is provided an apparatus for the separation and recovery of recyclable material from solid waste material, which apparatus comprises a cylindrical vessel that is capable of being rotated about its longitudinal axis and capable of withstanding elevated pressures, said vessel comprising:

a) an exterior wall surface, b) an interior wall surface, c) a first axial end, d) a second axial end, b) a chamber for receiving waste material to be treated said chamber defined by said interior wall surface and said first axial end and said second axial end, said chamber being sealed against pressure loss within said vessel, c) an inlet at said first axial end and an outlet at said second axial end, d) a feed assembly sealingly connected to said cylindrical vessel at said inlet for feeding solid waste material into said chamber, e) a flight assembly comprised of one or more flights secured to said interior wall surface and projecting radially inwardly from said interior wall surface such that its radial inner edge projects radially inwardly no more than about 80% of the distance from said interior wall surface to said longitudinal axis of said vessel, said flight assembly extending along said interior wall surface in a helical pattern from about said first axial end to about said second axial end, f) a primary tube secured to each of one or more of said flights of said flight assembly along substantially the entire length of said flight, said tube being sealingly and rotatably connected to a source of high pressure fluid, said tube having a plurality of orifices disposed along its length, said orifices being of a predetermined sizes that are sufficient to allow for the injection of jets of high pressure fluid into said chamber.

BRIEF DESCRIPTION OF THE FIGURES

FIG. 4A shows the feed assembly in position to be loaded with waste material to be treated. FIG. 4B shows the feed assembly after loading and after being slid into the pressure vessel chamber. FIG. 4C shows the feed assembly in position wherein the waste material is dumped in the pressure vessel.

DETAILED DESCRIPTION OF THE INVENTION

Figure 1:
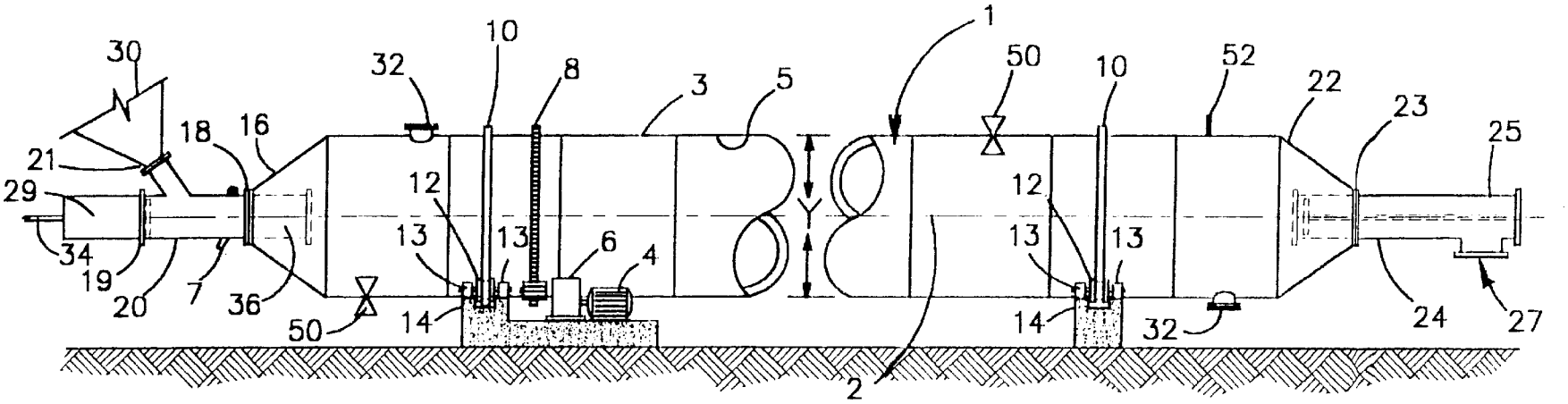
FIG. 1 is an elevational view of a preferred process vessel in accordance with the present invention.

The practice of present invention on solid waste material, such as a municipal solid waste, accomplishes, inter alia, the following: a) fractionalization, fragmentation, and reduction of: i) the cellulosic components (long-chain and/or cross-linked, insoluble carbohydrates) of the organic portion of mixed municipal solid waste and other biomass material, into its base component parts of cellulosic fiber (short-chain carbohydrates); ii) assorted minerals and trace metals; iii) water; iv) fats, oils or other lipids; b) the denaturing and fragmentation of the proteinaceous portions of the organic components; c) the reduction of the moisture content of the treated waste; and d) the sterilization and preparation of the inorganic components of such waste materials. This is accomplished as a result of the fractionalization and hydrolyzation of the organic constituents by subjecting the solid waste material to heat, pressure, and the cutting/agitating action of jets of high pressure fluid, preferably forced steam, and more preferably alternating steam and air into the chamber of a rotating pressure vessel. The mixing and homogenization of the waste material is accomplished in several ways. For example, it is accomplished by the rotation of the vessel, the physical action of the helical flight assembly, and the cutting and agitating forces exerted by the jets of high pressure fluid that are emitted from orifices disposed along a tubular member (sparger line) and optionally its laterals that will be described in detail below with reference to FIGS. 5 and 6. Thus, the solid waste material, during treatment, continuously churns and agitates during its flight through the vessel, thus shortening the treatment time needed to reach the desired end products.

Processing of mixed municipal solid waste in accordance with the present invention results in the sterilization and preparation of the inorganic components (including glass, metals and insoluble organic constituents such as rubber, plastics, and synthetics, etc.), thereby enhancing recoverability of these inorganic components and increasing their value as end products. Vapor and water discharge from the vessel, and the moisture content of the discharged end-product material, is controlled by use of positive pressure vacuum for recovering moisture and vapor from the vessel as well as from the material being processed. The resulting effluent end-product, or discharge, is captured in a collection vessel (not shown) for subsequent filtration of solid particulate. The recovered water can be recirculated as process make-up water to a boiler. The particulate matter recovered from such discharge can be returned to the pressure vessel for further processing. Feedstock of municipal solid waste, or other biomass, is introduced and discharged from the apparatus on a "semi-continuous" basis, preferably by use of a breech-type load mechanism, also referred to herein as breech-type feed or unloading assembly, by means of rotating connectors and air-lock systems that will be described in more detail below with reference to FIGS. 2, 3, and 4.

The solid waste material that is preferred for treatment in accordance with the present invention is municipal solid waste that will typically include both: (a) an organic portion such as agricultural and forestry wastes, foods, paper, plastics, fabrics, and wood residues; and (b) an inorganic portion such as concrete pieces, bricks and other fired clays, glass, metals, stones, synthetics, etc. It is preferred that the weight percentage of the organic portion of the untreated municipal solid waste material be at least about 30 wt %, more preferably about 40–80 wt. %, based on the total weight of the waste material. The table below shows the composition of typical dry municipal solid waste (MSW) as determined by the Environmental Protection Agency.

| Composition of Municipal Solid Waste | |
|---|---|
| Organics | 74.0% |
| Ferrous Metals | 7.5% |
| Non-Ferrous Metals | 1.5% |
| Glass | 10.0% |
| Plastics | 5.0% |
| Non-Organics | 2.0% |

Referring now to the Figures hereof, FIG. 1 depicts a preferred apparatus of the present invention. The preferred apparatus includes a cylindrical pressure vessel 1 having an exterior wall surface 3, an interior wall surface 5, a first axial end 16, and a second axial end 22. Although the cylindrical pressure vessel can be of any suitable diameter and length, it is preferred that it's diameter be from about 10% to about 15% of its length. The overall length of the pressure vessel 1 can be any suitable length that will allow for an effective residence time of waste material in the pressure vessel for a predetermined rate of vessel rotation and process conditions, including temperature and pressure. The overall length of the pressure vessel will typically be from about 80 to 120 feet. The chosen ratio between diameter of the vessel and its length is of course not critical and will depend on such things as the amount of helical pitch and the frequency (tip to tip) of the flight geometry, which will be described below with reference to FIG. 5. The pressure vessel can be fitted with at least one access manway 32, or port, with sealable covers. FIG. 1 shows two manways 32 that are preferably located near each axial end of the pressure vessel and opposed from each other. Manways are well known the art and they are typically die formed dome-type manhole frames and covers with saddles (or repads) rolled to fit the diameter of the pressure vessel or reinforced pipe nipples with flanges. The manways are provided to allow a workman to enter the pressure vessel when not in use for such purposes as cleaning, unplugging, and repair. It is within the scope of this invention that the pressure vessel contain one or more observation ports (not shown) set in the wall of the vessel to allow one to observe the waste material during treatment.

Pressure vessel 1 is mounted for rotation about its longitudinal axis 2. Rotation of the vessel can be caused by any suitable means known in the art FIG. 1 shows one preferred embodiment wherein the rotation is provided by a drive assembly that is comprised of a pair of trunnions 10 that also serve as stiffening braces and that are concentrically welded around the periphery of the vessel. The trunnions rest on two sets of wheels 12 (only one wheel of each set is shown). The wheels can be constructed form any suitable material, such as a metal or polymer composition, including elastomers and the like. It is preferred that the wheels be of an elastomeric material, such as rubber tires. The wheels 12 are set in suitable supporting structures, such as pillow blocks 14. FIG. 1 also shows sets of roller bearings 13 for supporting each set of wheels to ease rotation.

Rotation is accomplished by use of a motor 4 having an output gear 6 in meshed relationship with spur-type, or gear-type ring 8 secured around the periphery of the vessel. Rotation of the vessel can also be achieved by directly causing the wheels to rotate, which will then cause the vessel to rotate.

Pressure vessel 1 is caused to rotate about its longitudinal axis at a predetermined rotation speed, that can be readily varied. It is preferred that the waste material being processed be rotated an effective number times during its trip through the pressure vessel. By effective number of times we mean that minimum number of times needed to establish an effective residence time of the material in the pressure vessel. By effective residence time, we mean that minimum amount of time needed for the sterilization of the inorganic component and sufficient fractionalization, fragmentation, and denaturing of the organic material component aided by the cutting/agitation action of jets of high pressure fluid. For example, it order to obtain a desirable effluent product, the long chain carbohydrates of organic materials need to be broken into smaller chain carbohydrates. The precise residence time is of course dependent on such things as the nature of the material being treated, the amount of heat supplied by steam, the moisture content of the material being treated, and the pitch of the flights. Typically, the residence time will be from about 30 to 90 minutes, preferably from about 40 to 70 minutes. The number of revolutions of the vessel for any given waste material moving through the vessel, will typically be not less than about 300 revolutions, preferably not less than about 320 revolutions, and more preferably not less than about 340 revolutions. It is within the scope of the invention that the rotation of the vessel be reversible.

Figure 6:
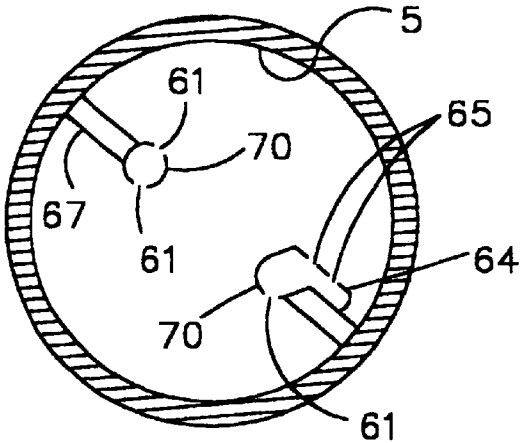
FIG. 6 is a partial cross-sectional view of the pressure vessel of FIG. 4 taken along line 5—5 showing the embodiment of the present invention relating to the sparger line in relation to the helical flight.

First and second axial ends 16 and 22, respectively, of pressure vessel 1 can be any suitable geometric configuration. Although they can merely be composed of a flat metal plate, it is preferred that they be tapered. It is more preferred that they be flanged domes or conical heads, most preferably 2:1 semi-elliptical heads. It is also within the scope of this invention that the taper of the axial end closures be provided by a concentric reducer defined by the interior wall of the axial end section of the pressure vessel, with or without a flat plate end member. While the angle of incline, or taper, is not critical, it will preferably be from about 0° to 90°, more preferably from about 30° to 75°, and most preferably from about 45° to about 65°. The length of the conical head, if used, is not critical, but it will preferably be approximately $1/16^{th}$ of the length of the pressure vessel. In FIG. 1, first axial end closure member 16 terminates with a flange 18, which is preferably a forged steel weld neck pressure vessel flange that is known in the art. This cone and flange is mated to a stationary feed, or hopper, tube 20 having a port 21 by means of an air lock assembly and rotating mounting assembly (not shown). Tube 20 will also contain a fitting 7 for receiving a suitable line for introducing fluid, such as steam and air into the pressure vessel. It is preferred that the wall of tube 20 be jacketed so that the fluid can be introduced through the jacket and through nipple, or fitting 31 of air lock barrel 36 (FIG. 2) which will be in fluid communication with tube 70 (FIG. 6). One type of "air lock" system suitable for use herein is one that is well known in the art and that typically includes a pair of separate pressurizable chambers. The preferred "air-lock" system for use herein is a breech-type system that will be described below when describing the feed assembly illustrated in FIGS. 2, 3 and 4 hereof.

FIG. 1 also shows loading hopper 30 in association with port 21. It is to be understood that a hopper need not be used in the practice of the present invention. The only requirement is that a structure be provided so that the solid waste material to be treated can be fed into inlet port 21 by any suitable technique. For example, the waste material can merely be shoveled or dumped into port 21. Alternatively, a suitable hose can be connected to port 21 so that the waste material can be pumped through port 21 and into the feed assembly. Stationary extension tube 29 is also provided to allow for containment of the air lock piston when in charging mode and which will described below with reference to FIG. 4.

Figure 2:
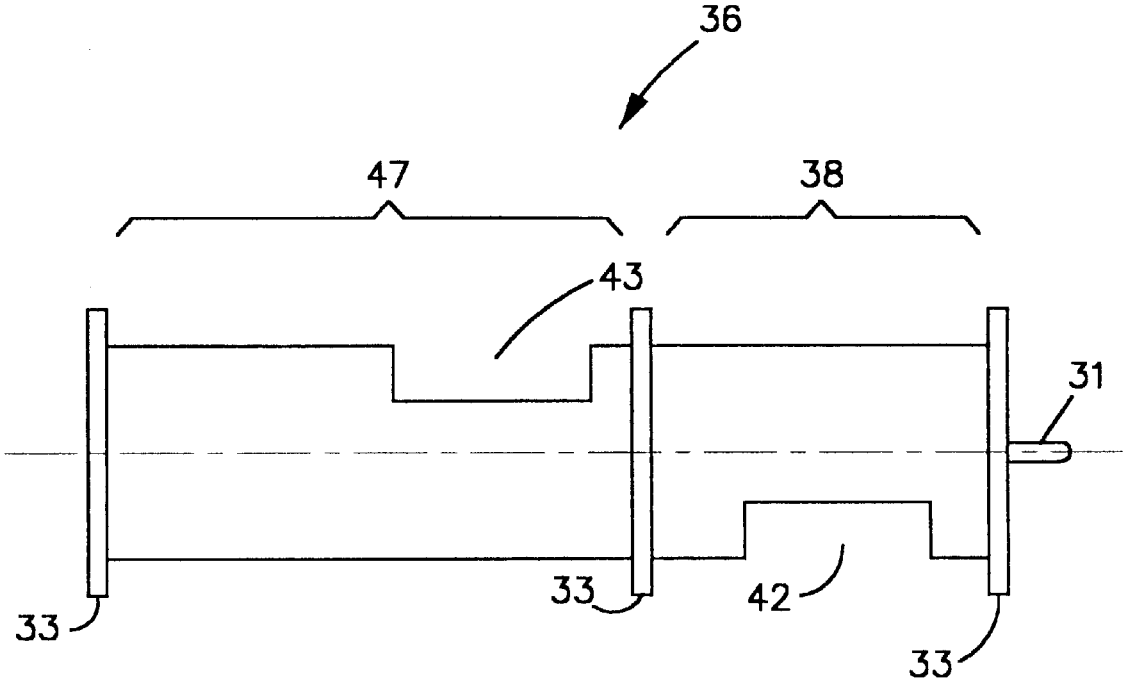
FIG. 2 is a side view of a preferred air lock barrel component of a preferred breech-type feed assembly suitable for use in the instant invention.
Figure 3:
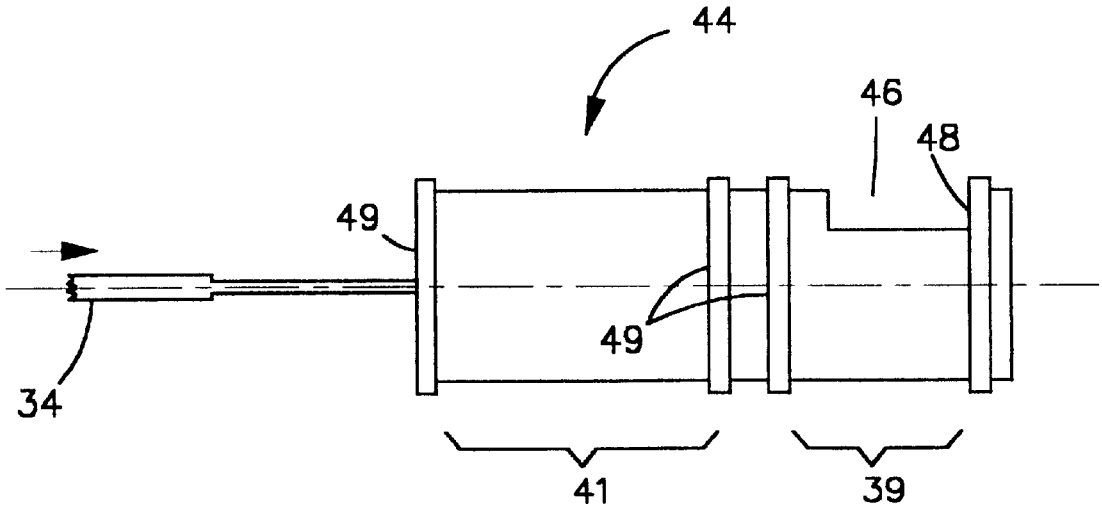
FIG. 3 is a side view of a preferred air lock cylinder component of the breech-type feed assembly of the present invention.
Figure 4A:
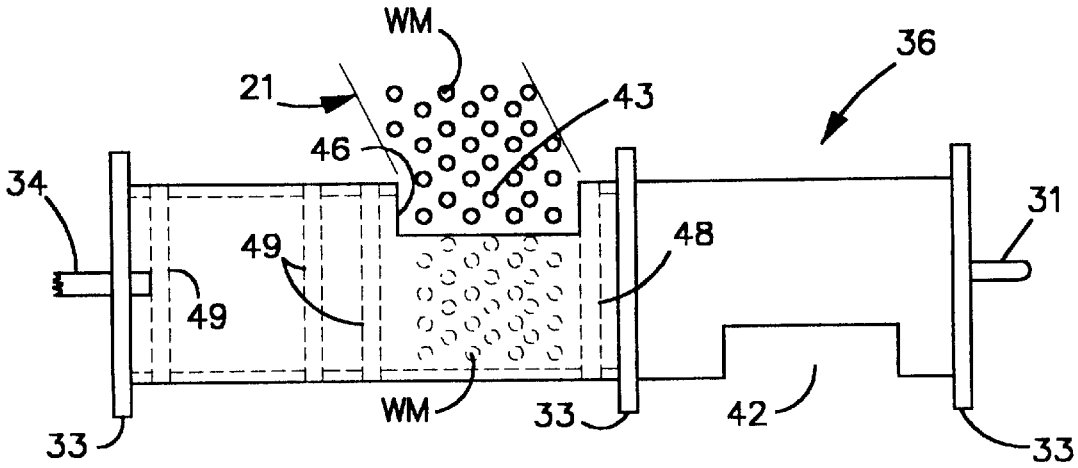
FIGS. 4A, 4B, and 4C show the breech-type feed assembly in three loading positions.

Second axial end 22 of the vessel, which is preferably fitted with a conical head or a 2:1 semi-elliptical head and a flange 23 and stationary discharge tube 24 which is similar to 18 and 20 respectively, at the feed end of the pressure vessel. Discharge rotating tube 24 includes at least one discharge port 27. The system for feeding the waste material into the pressure vessel can be any suitable feed system, and such systems are well known in the art. For example, it can be comprised of the system taught in U.S. Pat. No. 5,190,226, and incorporated herein by reference, that teaches the use of an "air-lock" system comprised of a pair of separate pressurizable chambers. A preferred feed system is a breech-load feed assembly such as the one depicted in FIGS. 2, 3, and 4 hereof. Such a system, which is more typically used for feeding munitions into guns, includes a ram, or bolt 34 (FIGS. 1 and 4), a fixed air lock barrel 36 and a slidable and rotatable air lock piston 44 (FIGS. 2 and 3 respectively). Air lock barrel 36 contains a forward section 38 and an aft section 47. The forward section 38 is comprises an opening, or port, 42 that faces downwardly to allow the waste material to be dropped into the pressure vessel during loading. Aft section 47 also contains an opening, or port, 43 that faces upwardly to allow waste material to be fed into the chamber 46 of air lock piston 44. Air lock barrel 36 is sealingly secured within the vessel structure for the first axial end 16 to the end of extension pipe 29 (FIG. 1). Port 42 of air lock barrel 36 will be facing downwardly and within the vessel chamber to allow waste material to be loading into the vessel from chamber 46 of air lock piston 44. Port 43 will be disposed in an upwardly direction under port 21 to allow waste material to be fed into chamber 46 of air lock piston 44. Air lock piston 44 contains a forward section 39 and an aft section 41, the forward section of which contains chamber 46. Air lock piston 44 is slidable along its longitudinal axis and is also rotatable. Air lock piston 44 contains a chamber 46 in its forward section 39 for receiving and transporting waste material into said pressure vessel. The dimensions of chamber 46 will be substantially the same as the opening of ports 42 and 43 to allow for non-restricted loading and unloading of waste material. It is within the scope of this invention that the dimensions of said opening of said chamber 46 be smaller than the opening of either one or both of ports 42 and 43. Air lock piston 44 also contains at least one primary seal ring 48 that is capable of sealing the piston periphery and preventing steam from escaping during vessel loading. Air lock piston 44 also contains intermediate seals 49 that can also serve as wipers. Additional tash wipers (not shown) can also fitted onto the air lock piston 44 to protect the seal rings.

Figure 4B:
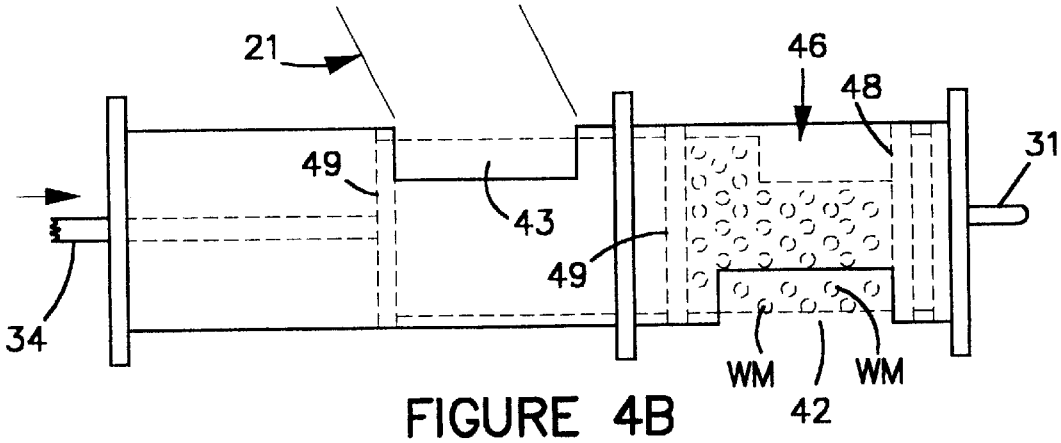
Figure 4C:
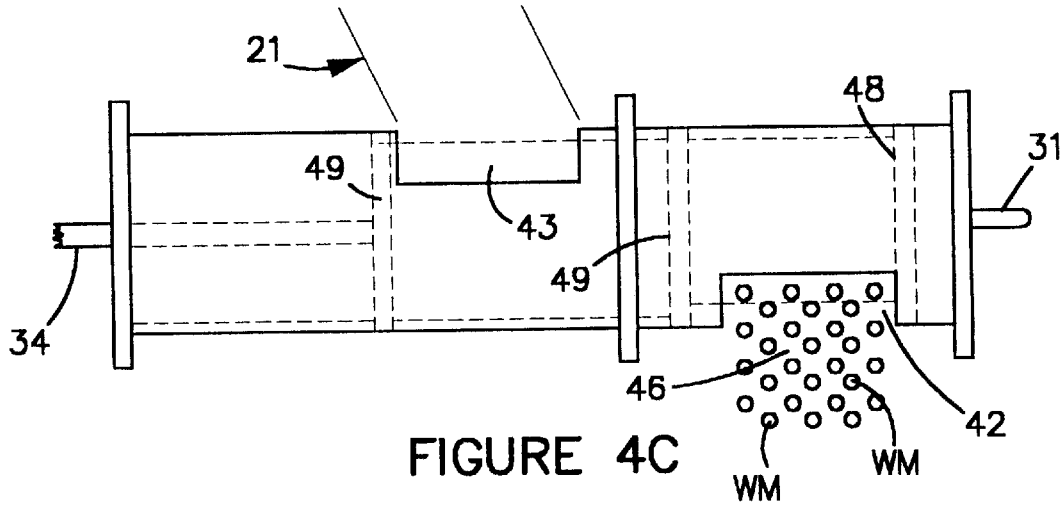

In operation, the ram 34 (FIGS. 1 and 4A) is first slid backward from the vessel along its longitudinal axis and suitably rotated so that chamber 46 of air lock piston 44 is positioned underneath port 21 of feed tube 20. The waste material WM to be treated is passed from the charging hopper 30 into the port 21 and into chamber 46 of air lock piston 44. After filling chamber 46, the air lock piston 44 is advanced longitudinally to the primary seal 48 so that chamber 46 is within forward section 38 of air lock barrel 36 (FIG. 4B). Piston 44 is then rotated so that chamber 46 aligns substantially with port 42 of air lock barrel 36, thus venting chamber 46 to the internal pressure of the pressure vessel and causing the waste material to be dumped into the pressure vessel (FIG. 4C). It is preferred that the ram be hollow to provide a passage for steam inlet piping into the vessel. It is within the scope of this invention that the loading of waste material into pressure vessel 1 be performed either while the vessel is rotating or when it is at rest. It will be understood that the loading of the vessel can take place by first pushing piston 44 so that chamber 46 is within the forward section 38 of air lock barrel 36. The piston can then be rotated so that chamber 46 is aligned with port 42 to allow the waste material to dump into the pressure vessel.

Figure 5:
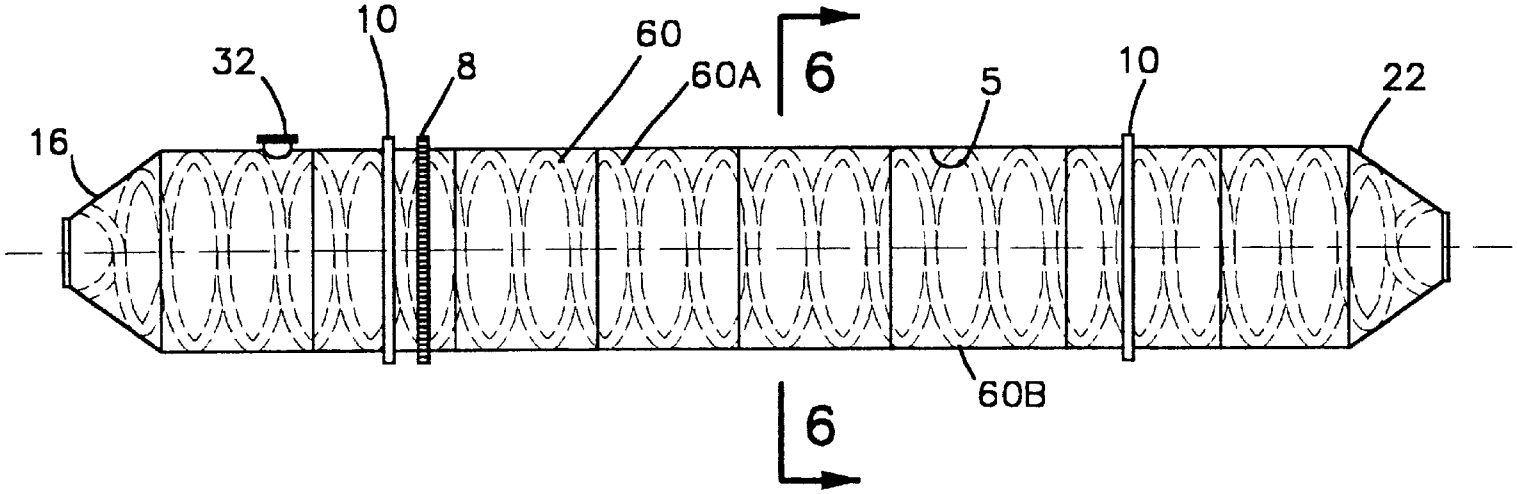
FIG. 5 is an elevational view of a preferred pressure vessel of the present illustrating the helical flight embodiment.

Once the waste material is in the pressure vessel, it is moved toward the discharge axial end while being subjected to mechanical forces generated by flight assembly 60 (FIG. 5 and 6). Referring now to FIG. 5, flight assembly 60 is shown and is preferably comprised of at least one, and more preferably at least two helical flights 60A and 60B. Each flight will be in the form of one or more blade structures secured to and radially projecting inwardly from the interior wall surface 62 of pressure vessel 1 toward its longitudinal axis of the vessel. The use of the word blade herein also includes the word vane. Each flight that comprises the flight assembly can be a single continuous blade or discontinuous blade segments, disposed along a predetermined helical path from about the first axial end to about the second axial end of said vessel. It is preferred that each flight be comprised of a continuous blade from about one axial end of the vessel to about the other axial end. The flight assembly will radially project inwardly toward the longitudinal axis of the vessel to an effective depth. That is, it will project radially inwardly toward the longitudinal axis of the vessel to such a depth that will be effective to agitate and move the material from about the feed axial end of the vessel to about the discharge axial end. The depth to which each flight will project radially inwardly will typically be no more than about 80%, preferably no more that about 60%, and more preferably no more than 30%, of the distance from the interior wall surface 5 to the longitudinal axis 2. The frequency of the flights, as measured from tip end to tip end, will be spaced a pretermined distance apart, which distance will be preferably closer toward the discharge axial end of the pressure vessel. Typically, the distance between tip to tip of the helical flight will be from about 12 to 18 inches. The helical flights will typically be comprised of steel plate of at least ½ inch in thickness. The flights should vary in helical pitch progressing from a greater pitch at the charging end of the vessel to a lesser pitch at the discharge end of the vessel. The frequency of the flights will also vary from a frequency that produces a "throw" of the material being treated of approximately twelve to fifteen inches at the charging end to a "throw" of about six to nine inches at the discharge end. By "throw" we mean the longitudinal distance the waste material will be moved with each rotation of the vessel.

Turning now to FIG. 6, which is a cross-sectional view of said flight assembly along line 5—5 of FIG. 5, a tube 70 (sparger line) is shown and is secured to at least one flight of the flight assembly. Tube 70 is provided, along its length, with a plurality of orifices 61. Tube 70 provides agitation and cutting from jets of high pressure fluid that are emitted through orifices 61 disposed along its length. It is preferred that the sparger line be welded onto the radially interior edge of the one or more flights. It is within the scope of this invention that the sparger line be secured at any location along the side surfaces of the flight(s) and not just the preferred radially interior edge. The orifices disposed along the length of the sparger line will preferably vary in diameter from approximately $1/16^{th}$ inch to about $1/8^{th}$ inch to provide the injection locations for jets of high pressure fluid, preferably steam or alternating steam and air. The jets of fluid are forced directly into the waste material as it moves through the vessel. The sparger line can also be fitted with laterals, or branching, tubulars 64 (FIG. 6) that are substantially perpendicular to the sparger line. The laterals will vary in length from ¼ to ¾ of the distance from the sparger to the interior wall surface of the vessel. It is also preferred that the lateral be spaced approximately 12 inches to 24 inches apart, preferably about 16 inches to 20 inches apart along the length of the sparger line. It is also preferred that the laterals be alternated between the feed side of the flight to the discharge side of the flight. A plurality of orifices 65 will also be disposed along the length of the laterals, which orifices will preferably be of varying diameters. It is preferred that the diameters of the orifices of the laterals be from approximately $1/8^{th}$ inch to $1/16^{th}$ of an inch.

The orifices, particularly those of the sparger line, are preferably directed medially and from perpendicular to approximately 45° along the vessel's longitudinal axis in the direction toward the discharge axial end of the vessel. The orifices of the laterals are preferably directed distally and from parallel of the flight to approximately 45° from parallel in direction of the opposing flight.

The varying diameters of the orifices 61 and 65 are preferably randomly selected in order to ensure that the amount of "head pressure" of steam being emitted from the individual orifices varies to ensure homogenization results. It is preferred that the orifices be located in such a way that they direct the jets of high pressure fluid toward the interior wall surface 5 of pressure vessel 1. It is also preferred that they be within 90°, preferably within 60°, from the side surface 67 of the flight. It is within the scope of this invention that the sparger contain orifices that point toward the center, or longitudinal axis, of the pressure vessel. At least an effective number of orifices, of an effective diameter, are provided at effective distances apart. That is, the orifices should be of sufficient number and size such that the pressure of the fluid being injected through the orifices is of sufficient force to provide a cutting/agitation action on the waste material being treated. The orifices will extend along the length of the sparger line so that at least 50%, preferably at least 75%, and more preferably at least about 90% of the length of vessel receives jets of high pressure fluid. It is preferred that the orifices that direct the jets of fluid toward the interior wall surface of the vessel be of greater diameter than the orifices that direct the jets of fluid toward the center of the vessel. For example, the orifices that direct the high pressure fluid back toward the interior wall surface can have a diameter of about 1/16 inch, whereas the orifices that direct the high pressure fluid toward the center of chamber of the pressure vessel can be about 1/125 inch. The end of each sparger line nearest the charging end of the pressure vessel will be sealingly and rotatably connected to a source of high pressure fluid, preferably steam and air. It is more preferred that it be fluidly connected to fitting 31 of air lock barrel 36. The steam and air will be delivered to the vessel through a suitable manifold structure. One preferred type of connection is a centrally mounted tee (not shown) for attachment to a rotating swivel joint (not shown) steam supply system, which connections and systems are well known in the art.

In operation, the waste material is moved through the pressure vessel by the helical flight assembly 60 during rotation of the vessel. During its movement through the pressure vessel, the waste material is subjected to the cutting and agitation action of the jets of high pressure fluid that are injected through the orifices of the sparger line and optionally laterals. It is preferred that the pressure vessel be operated within a temperature range from about 250° F. to about 300° F., more preferred is a temperature of about 260° F. to about 280° F. It is also preferred that the operating pressure in the vessel be from about 30 to about 70 psig, more preferred is a pressure of about 40 to 60 psig. Charging of the waste material into the pressure vessel is stopped when a predetermined effective volume of the vessel is occupied by the waste material. By effective volume we mean that the waste material should occupy enough of the vessel volume to make the process economically profitable and to have enough waste material to be cut, agitated and efficiently moved through the vessel at a sufficient treatment, or residence time. Effective volume also means that not too much waste material is fed into the vessel so that the movement of the material through the vessel would be impeded. It is preferred that the waste material occupy no more than about 40 vol. % of the pressure vessel chamber. Treatment of the waste material continues as the waste material moves through the vessel by continuing to subject the material to the jets of high pressure fluid and the rotation of the vessel. The high pressure fluid, as previously mentioned, is preferably selected from steam and dry, heated air. It is also preferred that the injection of steam and dry, heated air be alternated. That is, it is preferred to inject steam into the vessel for a predetermined period of time, followed by the injection of dry, heated air for a predetermined period of time, then the injection of steam, then a final treatment of heated dry air. A typical non-limiting steam/air cycle will be injecting steam first for period of time from about 15 to 25 minutes, followed by the injection of air for about 20 to 35 minutes, followed by another treatment of steam from about 15 to 25 minutes, followed by injection of air for about 15 to 25 minutes.

It is also within the scope of this invention that steam alone, without the injection of dry, heated air, be used throughout the treatment. During treatment, the pressure vessel continues to rotate and jets of high pressure fluid continues to be injected through the sparger line, and optionally laterals, to maintain an effective cutting/agitation action. If additional steam is required, it can be introduced into the pressure vessel by any appropriate means. When the waste material reaches the end closure member 22 it is squeezed back toward the charging end of the vessel. This causes any paper (cellulose) that was insufficiently broken down and processed during its movement through the vessel to be torn apart by compression and sheer action of the resulting indirect extrusion to complete the treatment process.

The desired level of treatment is reached when the desired end products are produced, which end products will have a moisture level substantially reduced from the virgin feed solid waste material. The moisture content of the waste material is monitored as it moves through the vessel. For example, virgin waste material will typically contain greater than 30 wt. % water, more typically greater than about 40 wt. % water. As previously stated, the moisture level of the desired end products will preferably be no greater than about 20 wt. %. Also, it is within the skill of those in the art to know that a certain residence time is needed in the pressure vessel for a given temperature and pressure and moisture content to sufficiently fractionalize, fragment, and denature the organic components and to sterilize the inorganic components.

It is within the scope of this invention that additional reagents be introduced into the pressure vessel along with the preferred fluids, steam and air. Non-limiting examples of such additional reagents include surfactants and dispersing agents.

After a solid waste material has reached the desired level of treatment, the treated waste material is removed from the vessel either while it is rotating, preferably when it comes to rest. The end-product material can be removed from the vessel by any suitable means. A preferred means would be to use the preferred breech-load (unload) system as described above for charging the vessel. For example, an air lock barrel and air lock piston, as illustrated in FIGS. 2, 3, and 4 hereof can be used to unload the waste material from the pressure vessel after treatment.

The pressure vessel can also be fitted with one or more "pop-off" type pressure release valves (not shown) that function as control mechanisms to ensure that the pressure generated inside of the vessel does not exceed operating parameters. The pressure vessel can also be fitted with multiple "quick connect" type nipples (also not shown) mounted 180° opposed from said pop-off valves, and preferably at the discharge end of the vessel. These "quick connect" type nipples will provide a means to remove vapor, particulate, condensate, and moisture by use of vacuum to maintain the desired level of each during treatment. The resulting liquid effluent product of the practice of this invention can be drawn from the vessel at intervals throughout treatment in order to remove excess moisture from the processed material during processing. This liquid effluent can be drawn from the vessel and collected in a collection tank (not shown), then passed through a sand (or equivalent) filter and then through a reverse osmosis (or equivalent) filtration system as is known in the art.

The solid, or particulate matter, from the filtration step can be recycled back to the pressure vessel. The water can also be routed back into a boiler as make-up water for the production of steam, as is known in the art.

It is preferred that the pressure vessel be inclined along its longitudinal axis slightly off of the horizontal and sloping downward from the charging end of the vessel to the discharge end of the vessel. This will enhance the movement of the waste material through the vessel. While, not critical, the degree of slope, off of true horizontal, will preferably be not more than about 4°.

Practice of the present invention will result in an end-product material comprised of a cellulosic pulp that is relatively dry and contains no more than about 30 wt. %, and preferably no more than about 20 wt. % of moisture. The end-product material will also contain inorganic components that are relatively clean (i.e. labels removed from glass containers, paint and coatings removed from metal containers, and plastic items that are easily segregated and recoverable). The end-product material is preferably then conveyed (by means that are well known in the art) from the discharge end of the pressure vessel to a rotating trommel for straining and segregation of the cellulosic pulp from the other components that are then sent to separation, size classification and recovery equipment for separation and collection of the inorganic components. The waste materials can be separated in the trommel by means of screens that include a first screen material having larger openings than a second screen that is mounted in spaced relation with the first screen layer. Separation is efficiently accomplished in the trommel since the organic waste material is more fluid while heated and pressurized. The cellulosic pulp is then further dried by any suitable means, such as by use of air, a fluidized bed dryer, a barometric dryer, or other suitable drying techniques that are well known in the art. The resultant carbohydrate/cellulosic pulp may then be used for any number of commerical applications, such as a clean-burning fuel source, stock for animal feeds, base material for composite building material products, acoustical or insulating material, or composting or fill material. The carbohydrate/cellulosic pulp product may also be biochemically converted to methane or ethanol.

The residence and/or cycle time, temperature and pressure control, fluid injection amount and time cycle, vacuum pressure and time cycle, and rotational speed, duration and direction, and operation of the rotating sleeve/ram inlet and discharge systems can all be controlled by a programmable logic control (PLC) system to maintain each variable within the designed operational parameters. It is also within the scope of this invention that adjustment of the operational parameters (residence time, steam injection amount and timing, rotational speed, and vacuum pressure and timing) be used to allow for operational adjustments sufficient to adapt to varying imput conditions. Such input conditions include, but are not limited to the constituency of the feed waste material, such as from high organic content feedstocks like bargasse or newprint or green waste, to the variations in mixed municipal solid waste. For example, variations in the composition of a mixed municipal solid waste will occur during rainy or dry collection periods.

Incumbent upon the invention is the manner that both pressurized steam and heated, dry air are introduced into the vessel, and thereby instilled into the material being processed, in the preferred alternating manner, thereby limiting any extraneous moisture from being introduced into the vessel. The present invention contemplates that a manifold or similar gathering mechanism be used for conducting both steam from a boiler system and heated, dry air for introduction into the vessel. The dry air may be, for example, collected from a reservoir tank that accepts pressurized air that may have been, for example, pre-heated by any suitable means. Non-limiting suitable means include use of a heater coil (such as electric) or use of a heat exchanger utilized in connection with the recovery of the pressurized steam from the pressure vessel during operation, or by a combination thereof, or by any other suitable means know by those having skill in the art.

What is claimed is:

1. An apparatus for the separation and recovery of recyclable material from solid waste, which apparatus comprises a cylindrical vessel that is capable of being rotated about its longitudinal axis and capable of withstanding elevated pressures, said vessel comprising:

a. an exterior wall surface, c) an interior wall surface, d) a first axial end, e) a second axial end, f) a chamber for receiving waste material to be treated said chamber defined by said interior wall surface and said first axial end and said second axial end, said chamber being sealed against pressure loss within said vessel, g) an inlet at said first axial end and an outlet at said second axial end, h) a feed assembly sealingly connected to said cylindrical vessel at said inlet for feeding solid waste material into said chamber, i) a flight assembly comprised of one or more flights secured to said interior wall surface and projecting radially inwardly from said interior wall surface such that its radial inner edge projects radially inwardly no more than about 80% of the distance from said interior wall surface to said longitudinal axis of said vessel, said flight assembly extending along said interior wall surface in a helical pattern from about said first axial end to about said second axial end, j) one or more tubes secured to each of said one or more of said flights of said flight assembly along substantially the entire length of said flight, said one or more tubes being sealingly and rotatably connected to a source of high pressure fluid, said tube having a plurality of orifices disposed along its length, said orifices being of a predetermined sizes that are sufficient to allow for the injection of jets of high pressure fluid into said chamber.

2. The apparatus of claim 1 wherein there is a single tube for each flight of said flight assembly, which tube is secured to the radial interior edge of said flight.

3. The apparatus of claim 2 wherein at least a portion of said orifices on said tube are located within 60° of said flight to which said tube is secured.

4. The apparatus of claim 2 wherein each flight of said flight assembly is a continuous one or more flights along said helical pattern along said interior wall surface.

5. The apparatus of claim 4 wherein said tube secured to the radial interior edge of said flights of said flight assembly contains a plurality of lateral tubes at predetermined locations along its length, said lateral tubes being in fluid communication and substantially perpendicular to said tube.

6. The apparatus of claim 2 wherein at least a portion of said orifices are provided with a means for directing a jet of high pressure fluid toward said second axial end of said vessel.

7. The apparatus of claim 2 wherein at least one of said fights of said flight assembly are disposed no more than about 50% from the interior wall surface of said pressure vessel to said longitudinal axis of said vessel.

8. The apparatus of claim 2 which contains a fitting at said inlet for receiving fluid to be injected from said orifices of said tube.

9. The apparatus of claim 2 wherein said feed assembly is disposed within said inlet of said vessel and which comprises: a) a fixed barrel structure having a forward axial section and an aft axial section wherein said forward axial section contains a port disposed within said chamber in downwardly direction; and b) a piston structure capable of sliding longitudinally and being rotated within said barrel structure, said piston structure also containing a forward axial section and an aft axial section wherein said forward axial section contains a chamber for feeding waste material to be treated into said vessel.

10. The apparatus of claim 1 wherein said flight assembly comprises at least two flights disposed substantially parallel to each other along said helical pattern along said interior wall surface and having a predetermined frequency as measured from tip to tip of said flights.

11. The apparatus of claim 1 wherein at least one of said fights of said flight assembly are disposed no more than about 50% from the interior wall surface of said pressure vessel to said longitudinal axis of said vessel.

12. The apparatus of claim 10 wherein the frequency of said flights are greater that said second axial end of said vessel that at said first axial end of said cylindrical vessel.

13. The apparatus of claim 1 wherein said flight assembly comprises a series of discontinuous flight segments along the helical pattern along said interior wall surface.

14. The apparatus of claim 1 wherein said flight assembly comprises a continuous one or more flights along said helical pattern along said interior wall surface.

15. The apparatus of claim 1 wherein said one or more tubes secured to said flights of said flight assembly contains a plurality of lateral tubes at predetermined locations along its length, said lateral tubes being in fluid communication and substantially perpendicular to said tube.

16. The apparatus of claim 1 wherein at least a portion of said orifices of said primary tube are located within 60° of the flight to which it is secured.

17. The apparatus of claim 16 wherein substantially all of said orifices of said one or more tubes are located with 60° of the flight to which said one or more tubes are secured.

18. The apparatus of claim 1 wherein at least a portion of said orifices are provided with a means for directing a jet of high pressure fluid toward said second axial end of said vessel.

19. The apparatus of claim 18 wherein substantially all of said orifices are provided with a means for directing a jet of high pressure fluid toward said second axial end of said vessel.

20. The apparatus of claim 1 wherein at least a portion of said orifices of said primary tube are located within 60° of the flight to which it is secured.

21. The apparatus of claim 20 wherein substantially all of said orifices are located with 60° of the flight to which said tube is secured.

22. The apparatus of claim 1 which contains a fitting at said inlet for receiving fluid to be injected from said orifices of said one or more tubes.

23. The apparatus of claim 1 wherein said feed assembly is disposed within said inlet of said vessel and which comprises: a) a fixed barrel structure having a forward axial section and an aft axial section wherein said forward axial section contains a port disposed within said chamber in downwardly direction; and b) a piston structure capable of sliding longitudinally and being rotated within said barrel structure, said piston structure also containing a forward axial section and an aft axial section wherein said forward axial section contains a chamber for feeding waste material to be treated into said vessel.

24. A method for processing a solid waste material for recycling comprising:

a) introducing a predetermined quantity of solid waste material into a rotatable cylindrical vessel having an interior wall surface and containing a pressure chamber having an inlet and an outlet and further comprising a flight assembly comprised of one or more flights secured to said interior wall surface and projecting radially inwardly from said interior wall surface such that its radial inner edge projects radially inwardly no more than about 80% of the distance from said interior wall surface to said longitudinal axis of said vessel, said flight assembly extending along said interior wall surface in a helical pattern from about said first axial end to about said second axial end, and wherein said one or more flights contain one or more tubes secured to each of said one or more of said flights of said flight assembly along substantially the entire length of said flight, said tube being sealingly and rotatably connected to a source of high pressure fluid, said tube having a plurality of orifices disposed along its length, said orifices being of predetermined sizes that are sufficient to allow for the injection of jets of high pressure fluid into said chamber;

b) causing said pressure vessel to rotate at a predetermined rate of rotation, thereby agitating and moving said waste material from the inlet to the outlet of said chamber;

c) pressurizing said vessel and heating said waste material to a predetermined pressure and temperature by injecting a heated fluid into said pressure chamber;

d) cutting and further agitating said waste material as it moves through said chamber by use of jets of high pressure fluid emitted through said orifices of said one or more tubes of said one or more flights of said flight assembly;

e) recovering the resulting product mix from said vessel for classification; and separating and recovering the recyclable materials from said classified material.

25. The method of claim 24 wherein said flight assembly comprises two or more continuous flights along said helical pattern along said interior wall surface.

26. The method of claim 25 wherein there is a single tube for each flight of said flight assembly, which tube is secured to the radial interior edge of said flight.

27. The method of claim 26 wherein the fluid is steam.

28. The method of claim 27 wherein steam is first injected into said chamber, followed by air, followed by steam, then ending with air.

29. The method of claim 24 wherein the moisture of said waste material is controlled by the injection of air.

30. The method of claim 29 wherein the moisture of said waste material is controlled by the injection of air and removal of excess moisture from said chamber.

31. The method of claim 24 wherein the waste material is removed from said vessel when its moisture content is less than about 20%.

* * * * *